US010801202B2

(12) United States Patent
Chitsaz et al.

(10) Patent No.: US 10,801,202 B2
(45) Date of Patent: Oct. 13, 2020

(54) CONNECTION CLIP FOR SECURING A PANEL TO A SUPPORT GRID

(71) Applicant: CertainTeed Canada, Inc., Toronto (CA)

(72) Inventors: Ali R. Chitsaz, Thornhill (CA); Christopher Wiesener, Orangeville (CA)

(73) Assignee: CertainTeed Canada, Inc., Toronto (CA)

( * ) Notice: Subject to any disclaimer, the term of this patent is extended or adjusted under 35 U.S.C. 154(b) by 0 days.

(21) Appl. No.: 16/456,355

(22) Filed: Jun. 28, 2019

(65) Prior Publication Data

US 2020/0002943 A1 Jan. 2, 2020

Related U.S. Application Data

(60) Provisional application No. 62/691,985, filed on Jun. 29, 2018.

(51) Int. Cl.
*E04B 9/22* (2006.01)
*E04B 9/24* (2006.01)
(Continued)

(52) U.S. Cl.
CPC ..... *E04B 9/22* (2013.01); *E04B 9/225* (2013.01); *E04B 9/24* (2013.01); *E04B 9/26* (2013.01); *E04B 2009/062* (2013.01)

(58) Field of Classification Search
CPC .... E04B 2009/062; E04B 9/225; E04B 9/205; E04B 9/24; E04B 9/008; E04B 9/22
See application file for complete search history.

(56) References Cited

U.S. PATENT DOCUMENTS 3,163,961 A * 1/1965 Kemp ..... E04B 9/22 52/144
3,594,972 A * 7/1971 Jones ..... E04B 9/064 52/716.1

(Continued)

FOREIGN PATENT DOCUMENTS

KR 200174945 Y1 3/2000
WO 2005019557 A1 3/2005

OTHER PUBLICATIONS

Decoustics, Linear Wood Grille Ceiling Systems Installation Manual (2013).

(Continued)

*Primary Examiner* — Andrew J Triggs
(74) *Attorney, Agent, or Firm* — McDonnell Boehnen Hulbert & Berghoff LLP

(57) ABSTRACT

The present disclosure relates generally to a connection clip for securing a panel to a support grid, for example, suitable for securing a wood grille panel to a ceiling grid. The present disclosure relates more particularly to a connection clip including a body having a base with a width extending between opposing first and second lateral edges and first and second arms extending upward respectively from the first and second lateral edges of the base so as to form a cavity configured to receive a structural cross member of the panel. Engagement lips extend laterally inward from an upper end of each arm and are configured to grip respective first and second flanges of a grid member of the support grid so as to secure the panel to the grid member. Each of the first and second engagement lips span a substantial majority of the depth of the connection clip.

19 Claims, 5 Drawing Sheets

(51) Int. Cl.
*E04B 9/26* (2006.01)
*E04B 9/06* (2006.01)

(56) References Cited

U.S. PATENT DOCUMENTS 4,073,108 A * 2/1978 Williams ..... E04B 2/825 52/238.1
4,926,606 A * 5/1990 Hanson ..... E04B 9/005 52/463
5,609,007 A * 3/1997 Eichner ..... E04B 9/064 52/506.07
8,695,296 B2 * 4/2014 Bergman ..... E04B 9/205 52/243.1
9,279,251 B2 * 3/2016 Bergman ..... E04B 9/225
9,765,519 B2 * 9/2017 Bergman ..... E04B 9/205
9,874,013 B2 * 1/2018 Bergman ..... E04B 9/0435
10,294,664 B2 * 5/2019 Bergman ..... E04B 9/008
2002/0112424 A1 8/2002 Zaborowski
2011/0247284 A1 * 10/2011 Butcher, Jr. ..... E04B 9/005 52/288.1
2012/0291397 A1 * 11/2012 Bergman ..... E04B 9/34 52/745.21
2014/0190109 A1 * 7/2014 Bergman ..... E04B 9/225 52/506.05
2015/0337538 A1 * 11/2015 Florenske ..... E04F 13/0812 52/481.1
2018/0334803 A1 * 11/2018 Underkofler ..... E04B 9/065
2020/0002943 A1 * 1/2020 Chitsaz ..... E04B 9/366

OTHER PUBLICATIONS

Armstrong Ceiling Solutions, Wood Works Grille Solid Wood Panels brochure (2017).
Armstrong Ceiling Solutions, Woodworks Grille datasheet (2017).

* cited by examiner

CONNECTION CLIP FOR SECURING A PANEL TO A SUPPORT GRID

CROSS-REFERENCE TO RELATED APPLICATIONS

This application claims the benefit of priority of U.S. Provisional Patent Application 62/691,985, filed Jun. 29, 2018, which is hereby incorporated herein by reference in its entirety.

BACKGROUND OF THE DISCLOSURE

1. Field of the Disclosure

The present disclosure relates generally to a connection clip for securing a panel to a support grid, for example, suitable for securing a wood grille panel to a ceiling grid.

2. Technical Background

Panel s are convenient and effective for constructing architectural surfaces. The panels may be pre-fabricated and shipped to the construction location, allowing for efficient installation that covers a large surface area. If damaged, the panels can be wholly replaced, rather than requiring a custom repair of the architectural surface. In some cases, the panels can be removed to provide access to the area behind the panel.

Panels that are used to form an architectural surface, such as a ceiling or wall covering, are often supported by a structural grid that holds the panels in place. This allows flexibility in the design of the panels, because the supporting grid will provide the structural integrity needed for the architectural surface. In many instances, the panels are attached to the supporting grid using mechanical fasteners, such as screws. While such fasteners are effective in attaching the panels to the supporting grid, they are difficult to uninstall. Moreover, repeated installation and uninstallation of these mechanical fasteners can damage the supporting grid.

In some systems, panels are connected to the corresponding supporting grid using a clip. However, existing clips provide a very small contact area between the clip and the supporting grid. Accordingly, the strength of the connection is not strong and could result in an unexpected disconnection between the panel and the supporting grid. Further, intentional removal of existing clips often requires manipulating the portion of the clip that is behind the panel. For example, when such a clip is used with a ceiling panel, removal of the clip requires manipulating the portion of the clip that is above the ceiling panel.

The present inventor has recognized that a panel system that can be easily installed and uninstalled repeatedly would be attractive to designers and builders.

SUMMARY OF THE DISCLOSURE

In one aspect, the present disclosure provides a connection clip for securing a panel to a support grid, the connection clip comprising:

a body including:

a base having a width extending between opposing first and second lateral edges; and first and second arms extending upward respectively from the first and second lateral edges of the base so as to form a cavity configured to receive a structural cross member of the panel;

a first engagement lip extending laterally inward from an upper end of the first arm and configured to grip a first flange of a grid member of the support grid, the first engagement lip spanning a substantial majority of the depth of the connection clip; and a second engagement lip extending laterally inward from an upper end of the second arm and configured to grip a second flange of the grid member so as to secure the panel to the grid member, the second engagement lip spanning a substantial majority of the depth of the connection clip.

In another aspect, the disclosure provides a panel system comprising:

a support grid including a plurality of grid members including a first grid member;

a plurality of panels each including a structural cross member extending across the respective panel, the plurality of panels including a first panel; and a connection clip according to the disclosure securing the first panel to the first grid member, wherein the structural cross member of the first panel is received in the cavity formed by the body of the connection clip, and wherein the first and second engagement lips of the connection clip grip respective first and second flanges of the first grid member so as to secure the first panel to the first grid member.

In another aspect, the disclosure provides a method of installing the panel system of the disclosure, the method comprising:

aligning the structural cross member of the first panel with the first grid member;

opening the connection clip so as to provide access to the cavity formed by the body of the connection clip;

inserting the structural cross member of the first panel into the cavity;

inserting the first and second flanges of the first grid member into the cavity; and positioning the first and second engagement lips of the connection clip to respectively grip the first and second flanges of the first grid member so as to secure the first panel to the first grid member.

In another aspect, the disclosure provides a method of uninstalling the panel system of the disclosure, the method comprising:

opening the connection clip so as to increase a gap between the first and second engagement lips of the connection clip;

maneuvering the connection clip so as to move the first and second flanges of the first grid member through the gap between the first and second engagement lips;

maneuvering the connection clip so as to move the structural cross member of the first panel through the gap between the first and second engagement lips and remove the structural cross member from the cavity of the connection clip; and separating the first panel from the first grid member.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

As described above, the present inventors have noted that conventional attachment systems for connecting a panel to a support grid are difficult to repeatedly install and uninstall. Accordingly, one aspect of the disclosure is a connection clip for securing a panel to a support grid. The connection clip includes a body having a base with a width extending between opposing first and second lateral edges. First and second arms extend upward respectively from the first and second lateral edges of the base so as to form a cavity configured to receive a structural cross member of the panel. A first engagement lip extends laterally inward from an upper end of the first arm and is configured to grip a first flange of a grid member of the support grid. The first engagement lip spans a substantial majority of the depth of the connection clip. A second engagement lip similarly extends laterally inward from an upper end of the second arm and is configured to grip a second flange of the grid member so as to secure the panel to the grid member. The second engagement lip also spans a substantial majority of the depth of the connection clip.

Figure 1:
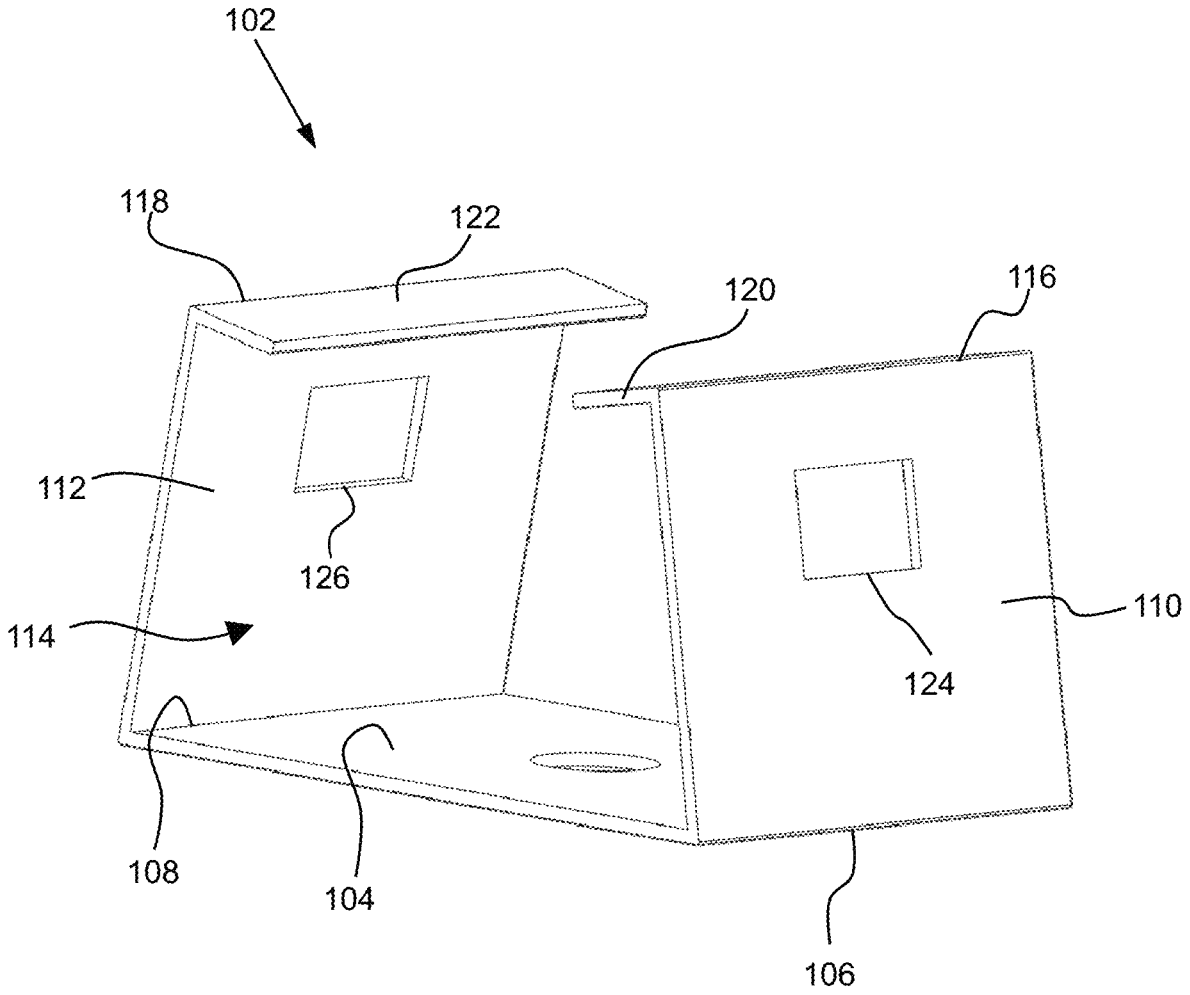
FIG. 1 is a schematic perspective view of a connection clip in accordance with an embodiment of the disclosure.

Such a connection clip is shown in perspective view in FIG. 1. Connection clip 102 includes a base 104 that extends from a first lateral edge 106 to a second lateral edge 108. As described herein, the width direction of base 104 runs between first lateral edge 106 and second lateral edge 108. Likewise, first lateral edge 106 and second lateral edge 108 run parallel to the depth direction of connection clip 102. A first arm 110 extends upward from the first lateral edge 106 of base 104 and a second arm 112 extends upward from the second lateral edge 108. Base 104, first arm 110, and second arm 112 form a cavity 114 therebetween to receive portions of the panel and grid member. The term upward, as used herein, refers to the orientation of connection clip 102 as shown in the drawings. However, connection clip 102 may be used in various different orientations with respect to gravity. For example, first arm 110 and second arm 112 may extend in a direction that is perpendicular to gravity when connection clip 102 is used to secure a vertically oriented panel that forms a portion of a wall covering.

A first engagement lip 120 extends laterally inward from an upper end 116 of first arm 110 and an opposing second engagement lip 122 similarly extends laterally inward from an upper end 118 of second arm 112. Both engagement lips 120, 122 are configured to grip a respective flange of a grid member, as explained in more detail below. The phrase laterally inward, as used in this context, refers to a direction that is at least partially toward the opposing engagement lip of connection clip 102, rather than away from or parallel to the other engagement lip.

Both first engagement lip 120 and second engagement lip 122 span the entire depth of connection clip 102. In other embodiments, the engagement lips do not extend across the entire depth of the connection clip, but span a substantial majority of the depth of the connection clip. The term substantial majority, as used herein, refers to at least 75% of the entirety of the depth of the connection clip. In some embodiments, the engagement lips extend across at least 80% of the depth of the connection clip, e.g., at least 90% of the depth of the connection clip, e.g., at least 95% of the depth of the connection clip. The large extension of the engagement lip across the depth of the connection clip provides a large bearing surface for engaging a grid member, as described in more detail below. Compared to clips having a smaller bearing surface, the enlarged bearing surface of the connection clip of the present disclosure provides a stronger connection between the panel and grid member.

In certain embodiments as otherwise described herein, the depth of each of the base, arms, and engagement lips are substantially equal. For example, in connection clip 102 the length of each of base 104, first arm 110, second arm 112, first engagement lip 120, and second engagement lip 122 is the same in the depth direction of connection clip 102. In other embodiments, the depth of the base, arms, and engagement lips vary. For example, in some embodiments, the base has a depth that is slightly larger than the depth of the engagement lips. In other embodiments, the engagement lips have a larger depth than the base. Further, while the depths of the opposing arms 110, 112 and engagement lips 120, 122 are the same in connection clip 102, in some embodiments, the connection clip is asymmetrical and the depth of one arm and/or engagement lip is larger than the depth of the opposing arm or engagement lip.

In certain embodiments as otherwise described herein, each of the base, arms, and engagement lips is composed of a planar element. For example, in connection clip 102, base 104, first arm 110, second arm 112, first engagement lip 120, and second engagement lip 122 are each rectangular planar elements that are connected to one another along shared edges. In other embodiments, these elements are non-planar. For example, in some embodiments, at least one of the base, arms, and engagement lips is corrugated. In other embodiments, at least one of these components is rounded. For example, in some embodiments the arms extend from the base in an arc.

In certain embodiments as otherwise described herein, the connection clip is formed from a bent metal sheet. The term metal sheet, as used herein, is not limited to any particular thickness and may include materials conventionally referred to as metal foil, sheet metal, metal plate, spring metal or metal strips. For example, connection clip 102 is formed from a sheet of metal that is cut to shape and bent into the form of the clip. Thus, first arm 110 and second arm 112 are both bent upward from base 104. Likewise, first engagement lip 120 is bent inward from the top of first arm 110 and second engagement lip 122 is bent inward from the top of second arm 112. In some embodiments, the connection clip is formed of bent steel, for example powder coated spring steel. In other embodiments, the connection clip is formed of aluminum or another metal. Bending each engagement lip inward where it joins the arm allows for precise and consistent placement of the bearing surface of the engagement lip. Accordingly, a group of connection clips can be manufactured with the same dimensions within a small tolerance such that each of the connection clips interact with a panel and corresponding support grid in the same way. In contrast, other clips that have a bearing surface that is punched from the surrounding material are more difficult to fabricate with consistent dimensions.

In other embodiments, the clip is formed of a material other than metal. For example, in some embodiments, the connection clip is formed of a plastic. In some embodiments, the connection clip is formed of a reinforced resin, such as a fiber reinforced plastic. In certain embodiments, different portions of the clip are formed of different materials. For example, in some embodiments, plastic engagement lips extend from metal arms. Further, in some embodiments, the connection clip is constructed in a manner other than by bending. For example, in some embodiments, the connection clip is cast or molded. In other embodiments, the connection clip is formed by additive manufacturing, such as 3D printing.

In certain embodiments as otherwise described herein, each of the first and second arms forms an acute angle with the base. For example, first arm 110 of connection clip 102 is disposed at an acute angle with base 104. Likewise, second arm 112 is also disposed at an acute angel with base 104. In certain embodiments, each arm is at an angle in a range from 65 to 87 degrees from the base, e.g., in a range from 75 to 85 degrees, e.g., in a range from 78 to 82 degrees. The acute angle between the arms and the base promote retention of the flanges of the grid member and the structural cross member of the panel within the cavity of the connection clip. For example, by angling toward one another, first arm 110 and second arm 112 form a constricted opening to the cavity and a narrower gap between the first engagement lip 120 and second engagement lip 122.

In certain embodiments as otherwise described herein, the first arm includes an aperture therethrough. For example, connection clip 102 includes a first aperture 124 that extends through first arm 110. As explained in more detail below, such an aperture may provide an engagement structure for installing and uninstalling the connection clip when attaching a panel to the supporting grid.

In certain embodiments as otherwise described herein, the aperture is positioned on an upper portion of the first arm. For example, first aperture 124 is positioned on an upper portion of first arm 110. The phrase upper portion, as used herein, refers to the half of the arm that is away from the base. Including the aperture on the upper portion of the arm provides additional leverage when using the aperture to open the connection clip.

In certain embodiments, the aperture extends in the depth direction of the clip in a range from ⅛ to 1 inch, e.g., from 3/16 to ½ inch, e.g., about ¼ inch. In some embodiments, the size of the aperture is configured to allow a standard hand tool, such as a screwdriver, to be inserted through the aperture in order to manipulate the connection clip.

In certain embodiments as otherwise described herein, the second arm also includes an aperture therethrough. For example, a second aperture 126 extends through second arm 112 on an upper portion thereof. Similar to first aperture 124, the second aperture 126 can be used to provide an engagement structure for manipulating the connection clip when installing and uninstalling the clip on the panel and grid member. Further, in some embodiments, the second aperture is the same size as the first aperture.

Figure 2:
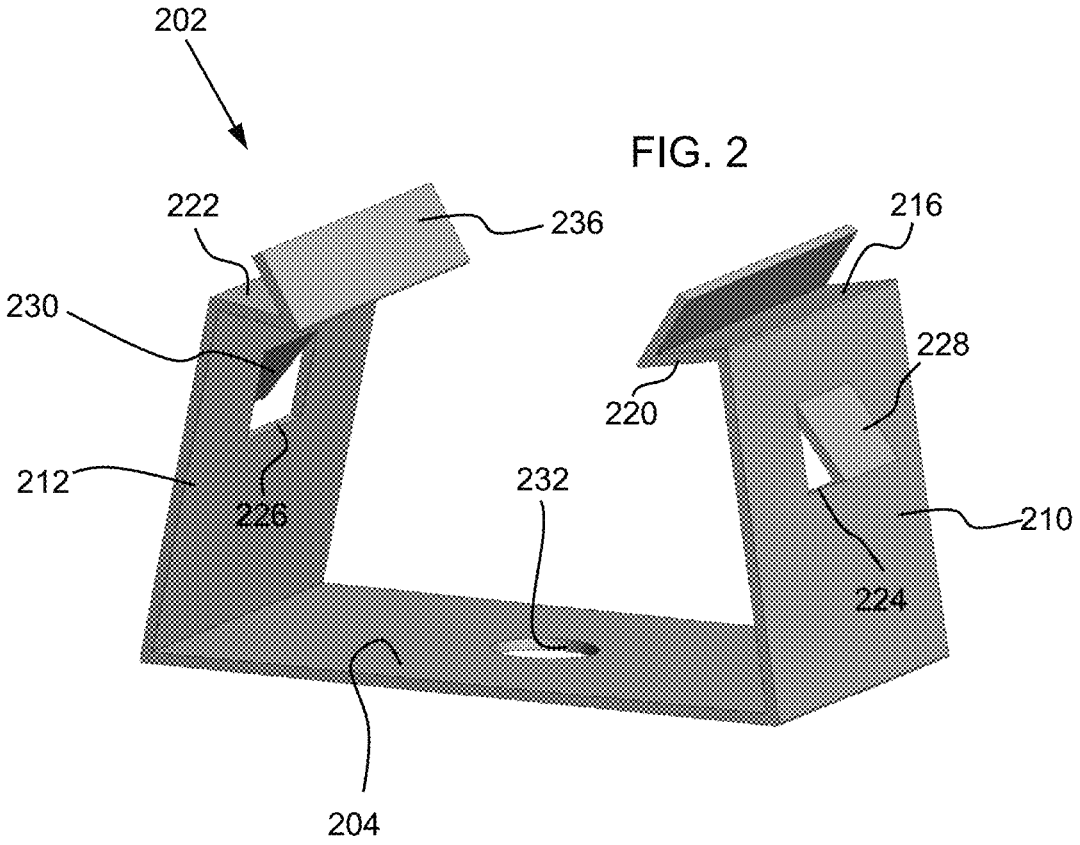
FIG. 2 is a schematic perspective view of a connection clip according to another embodiment of the disclosure.

In certain embodiments as otherwise described herein, the connection clip includes a tab extending laterally outward from the first arm. Such a connection clip is shown, for example, in FIG. 2. Connection clip 202 includes a base 204, a first arm 210, and a second arm 212, where the first arm 210 and second arm 212 both extend upward from the base. At the upper end of first arm 210 a first engagement lip 220 extends laterally inward. Likewise, at the upper end of second arm 212 a second engagement lip 222 extends laterally inward toward the first engagement lip 220. Each of first arm 210 and second arm 212 has a respective tab 228, 230 that extends laterally outward therefrom. In certain embodiments, the first tab is disposed at an angle to the first arm in a range from 10 to 50 degrees, e.g., from 15 to 45 degrees, e.g., from 25 to 35 degrees. In some embodiments, the first and second tabs are respectively disposed at the same angle to the first and second arms.

In certain embodiments as otherwise described herein, the tab is aligned with the aperture of the first arm. In some embodiments, the tab is a flap that is punched from the aperture of the first arm. For example, connection clip 202 includes a first aperture 224, and first tab 228 extends laterally outward over first aperture 224. Accordingly, first tab 228 is aligned with first aperture 224. Similarly, second tab 230 is likewise also aligned over second aperture 226. Furthermore, in connection clip 202, the respective tabs 228, 230 are of a similar size to apertures 224, 226 because the apertures are formed by punching out the tabs from the respective arms 210, 212.

In certain embodiments as otherwise described herein, the base includes a hole configured to receive a mechanical fastener, such as a safety mechanical fastener in areas where seismic requirements call for a mechanical fastener attachment. For example, base 204 of connection clip 202 includes a hole 232 disposed at the center thereof. Hole 232 is configured to receive the shaft of a mechanical fastener, such as a screw, where the head of the fastener secures base 204 to an element engaged by the mechanical fastener. In some embodiments, the hole has a diameter in a range from ⅛ inch to ⅜ inch, e.g., about 3/16 inch.

In certain embodiments as otherwise described herein, the inner end of each engagement lip includes an edge protrusion that projects outward from the lateral extension of the engagement lip. The added thickness provided by the edge protrusion inhibits accidental insertion of the engagement lip between the structural cross member of the panel and the grid member. In some embodiments, the edge protrusion is formed as a tab extending upward from the inner edge of the engagement lip. For example, each of first engagement lip 220 and second engagement lip 222 includes an edge protrusion 236 in the form of a tab that extends upward from the inner end of the respective engagement lip. In other embodiments, the edge protrusion is formed as an indentation near the edge of the respective engagement lip. For example, in some embodiments, the edge protrusion is in the form of a rib or a series of beads stamped into the engagement lip. In other embodiments, the edge protrusion is in the form of a folded hem at the edge of the engagement lip. In some embodiments, the edge protrusion extends across the entire depth of the respective engagement lip. In other embodiments, the edge protrusion extends across only a portion of the engagement lip. In some embodiments, both engagement lips include an edge protrusion. In other embodiments only one engagement lip of the connection clip includes an edge protrusion.

In certain embodiments as otherwise described herein, the connection clip has a depth between 0.25 and 2 inches, e.g., between 0.5 and 1 inch, e.g., about 0.75 inches. In some embodiments, the size of the clip in the depth direction is configured to allow the connection clip to attach to a structural cross member of a panel without interfering with other components of the panel. In other embodiments, the depth of the connection clip is larger.

In certain embodiments as otherwise described herein, the connection clip has a width between 0.75 and 2 inches, e.g., between 0.8 and 1.25 inches. In some embodiments, the width of the connection clip is adapted for attachment to a particular grid member, such as a ceiling grid member having a width of 15/16 or 9/16 of an inch.

In another aspect, the disclosure provides a panel system including a support grid having a plurality of grid members and a plurality of panels each including a structural cross member extending across the respective panel. The support grid includes a first grid member and the plurality of panels includes a first panel. The system also includes a connection clip according to any of the embodiments described above securing the first panel to the first grid member. The structural cross member of the first panel is received in the cavity formed by the body of the connection clip and the first and second engagement lips of the connection clip grip respective first and second flanges of the first grid member so as to secure the first panel to the first grid member.

Figure 3:
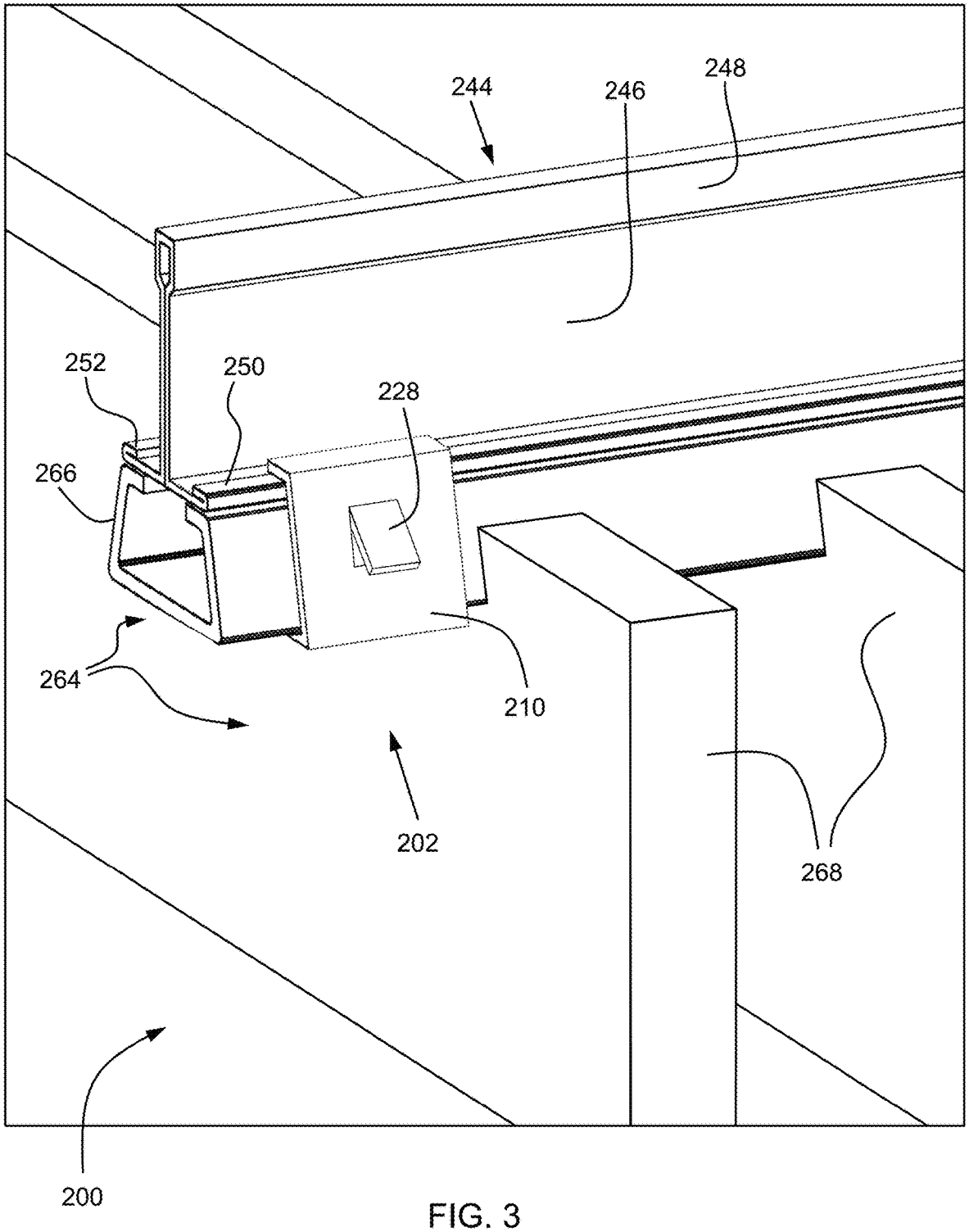
FIG. 3 is a schematic perspective view of a portion of a panel system using the connection clip of FIG. 2.

Such a panel system is shown in FIGS. 3-7. Panel system 200 includes a support grid 242 that is formed from a plurality of grid members including a first grid member 244. Panel system 200 also includes a plurality of panels 262 including a first panel 264. A detailed perspective view of first grid member 244 and first panel 264 secured together by connection clip 202 is shown in FIG. 3. First panel 264 includes a structural cross member (e.g., aluminum baton) 266 that extends across the panel and provides structural support for the panel. Structural cross member 266 is held within cavity 214 of connection clip 202 between first arm 210 and second arm 212. A portion of first grid member 244 is also disposed within cavity 214. In particular, first and second flanges of first grid member 244 are held within connection clip 202 such that first engagement lip 220 grips the first flange 250 of first grid member 244 and second engagement lip 222 grips the second flange 252 of the grid member. In such a configuration, connection clip 202 securely holds structural cross member 266 relative to first grid member 244.

In certain embodiments as otherwise described herein, the first panel is a ceiling panel and the support grid is a ceiling grid. For example, first panel 264 is a ceiling panel that covers the underside of support grid 242, which is formed as a structural ceiling grid. In other embodiments, the panels and support grids take other forms. For example, in some embodiments the first panel is a panel for a wall covering and the support grid is wall frame.

In certain embodiments as otherwise described herein, the first grid member is a t-beam including a central web extending upward from the first and second flanges. For example, first grid member 244 is a conventional elongate t-beam of a ceiling grid that includes first and second flanges 250, 252 that extend laterally outward from a planar central web 246. A bulb 248 is disposed at the top of web 246, opposite the flanges. Further, the ceiling grid is formed of a plurality of t-beams extending in a first direction and additional t-beams extending in a perpendicular direction so as to form the grid.

In certain embodiments as otherwise described herein, the structural cross member of the first panel abuts the first grid member. For example, in panel system 200, clip 202 is sized such that the structural cross member 266 and the flanges 250, 252 of first grid member 244 fit tightly within the cavity 214. As a result, structural cross member 266 is pressed up against flanges 250, 252. In other embodiments, the connection clip is larger and allows space between the structural cross member and the grid member. For example, in some embodiments, the connection clip hangs from the flanges of the grid member by the engagement lips, and the base of the clip cradles the structural cross member at a distance from the grid member.

Figure 4:
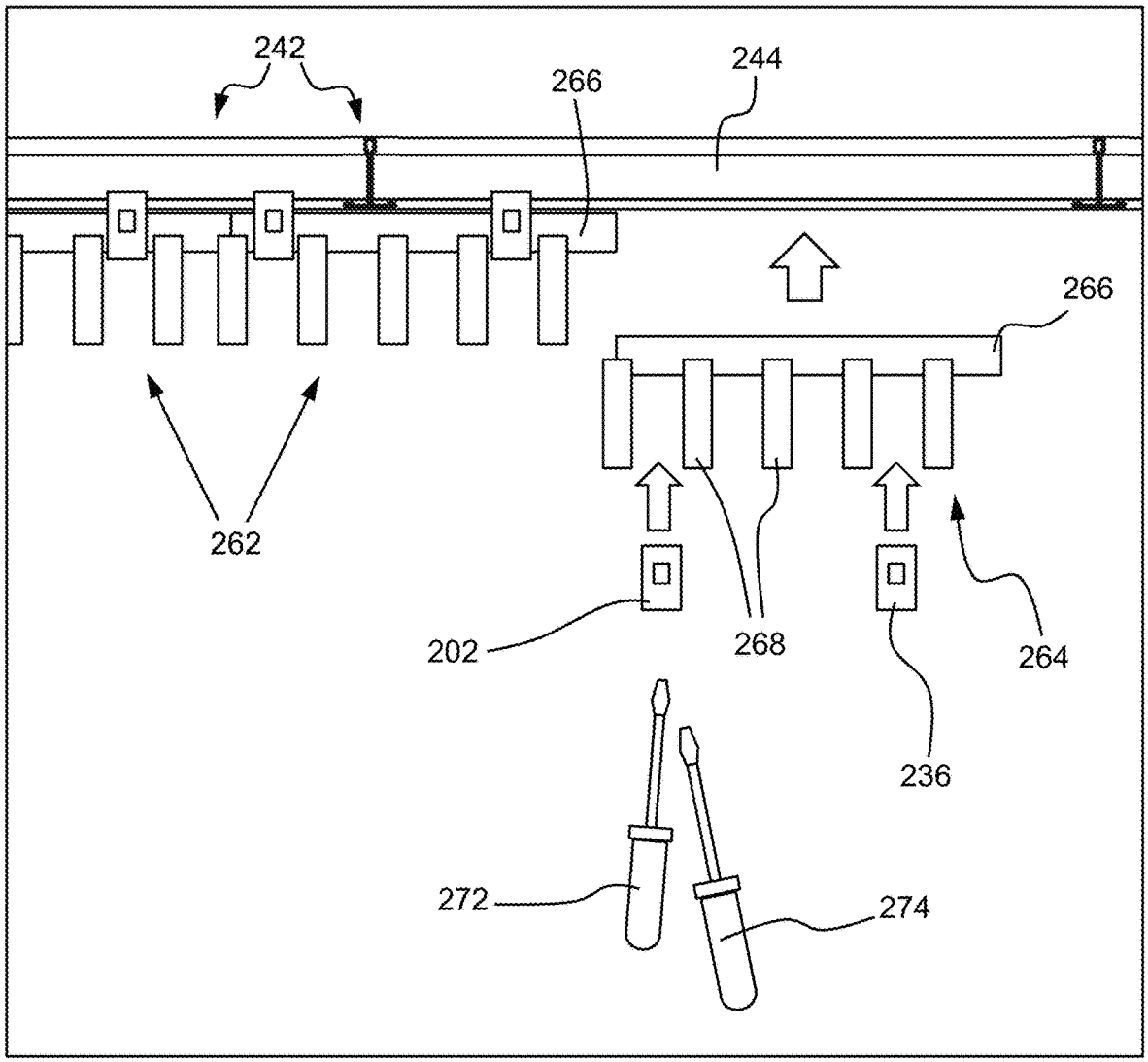
FIG. 4 is a schematic side view illustrating an installation of the panel system of FIG. 3 according to an embodiment of the disclosure.

In certain embodiments as otherwise described herein, the panel system further includes a second connection clip securing the first panel to the support grid. For example, FIG. 4 illustrates first panel 264 being installed onto first grid member 244 of support grid 242. As shown, connection clip 202 and a second connection clip 236 cooperate to hold first panel 264 to first grid member 244. Likewise, the other panels in system 200 are also secured to the support grid with a plurality of connection clips.

In certain embodiments as otherwise described herein, the second connection clip also secures the structural cross member of the first panel to the first grid member. For example, both connection clip 202 and second connection clip 236 are used to secure the same structural cross member 266 to the first grid member 244. In other embodiments, the second connection clip secures another structural cross member of the first panel to a second grid member of the support grid. For example, in certain embodiments, the panels include two or more structural cross members that each align with a corresponding grid member of the support grid, and connection clips are used to secure each of the structural cross members to the corresponding grid members.

In certain embodiments as otherwise described herein, each of the plurality of panels is secured to the support grid with connection clips. For example, in panel system 202, each of the panels 262, including first panel 264, is secured to support grid 242 with two connection clips. In other embodiments, some of the panels are connected to the support grid using connection clips and other panels are connected to the support grid using other means, such as mechanical fasteners. For example, in some embodiments, where a portion of the panel system warrants a more permanent connection, the panels forming that portion are connected to the support grid using mechanical fasteners while the remaining panels are connected to the support grid using connection clips.

In certain embodiments as otherwise described herein, the first panel includes a wood grille including a plurality of blades, and each of the blades is attached to the structural cross member. For example, the panels 262 in system 200, including first panel 264, are wood grille panels that each include several blades 268 attached to structural cross member 266. In some embodiments, the blades have the appearance of wood planks that are aligned in rows. In certain embodiments, the blades are formed from wood planks. In other embodiments, the blades are formed from a fibrous material, such as medium density fiberboard. Still in other embodiments, the blades are formed from a plastic, such as a filled or reinforced resin. In some embodiments, the blades have a laminate or other covering that give the blades the appearance of wood.

In certain embodiments as otherwise described herein, the structural cross member is disposed at the top of the first panel. For example, in panel system 200, the structural cross member 266 of each panel 262 is positioned at the top of the panel with the blades extending downward therefrom. In other embodiments, the structural cross members extend through a middle section of the blades. In such an embodiment, the structural cross member is positioned at a distance from the corresponding grid member, with the structural cross members hanging from grid members through the use of the connection clips.

In certain embodiments as otherwise described herein, the structural cross member is an aluminum baton. For example, structural cross member 266 is in the form of a hollow aluminum baton that extends through the blades of the wood grille. In other embodiments, the structural cross member is formed from another material, such as steel, or a fiber reinforced resin material. In some embodiments, the structural cross member has a solid cross section.

In certain embodiments as otherwise described herein, the structural cross member has a dovetail shape, and at least a portion of the structural cross member extends through the blades. For example, as shown in FIG. 3, structural cross member 266 has a dovetail shape that is wider at the bottom than at the top. This dovetail shape allows a secure attachment to be made between structural cross member 266 and the blades 268 because the wider bottom of the structural cross member is embedded in the upper end of the blades. Accordingly, the structural cross member is held within an opening in the blades that narrows toward the edge of the blade. As a result, the tapered sides of these opening provide a physical barrier to removal of the structural cross member 266 in a direction that is perpendicular to the support grid.

In certain embodiments as otherwise described herein, an upper portion of the structural cross member projects out from a top surface the blades. For example, the narrow top of structural cross member 266 sticks out from the top surface 270 of blades 268. In other embodiments, the upper edge of the structural cross member is flush with the top surface of the blades. Still in other embodiments, the structural cross member is spaced inward from the upper surface of the blades.

In certain embodiments as otherwise described herein, the connection clip is attached to the structural cross member using a mechanical fastener. The use of a mechanical fastener provides additional security between the connection clip and the structural cross member. In some embodiments, the panel is removable from the support grid while the connection clip is fastened to the structural cross member. In other embodiments, the mechanical fastener is removed so as to disconnect the connection clip from the structural cross member before the panel is removed from the support grid.

In some embodiments, the mechanical fastener passes through a hole in the base of the connection clip. For example, in one embodiment a mechanical fastener may pass through the hole 232 in connection clip 202 to attach the connection clip to structural cross member 266. In other embodiments, the mechanical fastener penetrates through the connection clip.

In another aspect, the disclosure provides a method of installing the panel system according to any of the embodiments described above. The method includes aligning the structural cross member of the first panel with the first grid member, opening the connection clip so as to provide access to the cavity formed by the body of the connection clip, inserting the structural cross member of the first panel into the cavity, and inserting the first and second flanges of the first grid member into the cavity. The first and second engagement lips of the connection clip are positioned to respectively grip the first and second flanges of the first grid member so as to secure the first panel to the first grid member.

Such a method is illustrated with respect to FIGS. 3 and 4, which show the installation of first panel 264 onto first grid member 244 of support grid 242. To attach first panel 264 to first grid member 244, the structural cross member 266 of first panel 264 is aligned with first grid member 244. Connection clip 202 is then opened in order to provide access to the cavity within connection clip 202. The connection clip 202 is then lifted upward in order to insert the structural cross member 266 and the first and second flanges of first grid member 244 into the cavity. When connection clip 202 is closed the first and second engagement lips are positioned to grip the respective flanges of first grid member 244, as shown in FIG. 3. In this position, first panel 264 is secured to first grid member 244.

In certain embodiments as otherwise described herein, the method further includes placing the structural cross member against the first grid member. For example, in the method depicted by FIGS. 3 and 4, first panel 264 is lifted upward until the upper surface of structural cross member 266 abuts the first and second flanges 250, 252 of first grid member 244. Connection clip 202 then secures first panel 264 to first grid member 244 with the structural cross member 266 in contact with first grid member 244.

In certain embodiments as otherwise described herein, opening the connection clip includes spreading the first and second arms so as to increase a gap between the first and second engagement lips of the connection clip. For example, in some embodiments, as the connection clip is prepared for attachment to the panel and grid member, the first and second arms of the connection clip are pulled away from one another by temporarily flexing the clip. This flexing of the clip can cause an increase in the angles between the arms and the base as well as an arcing of the arms and/or base. The result of flexing the clip is that the gap of space between the inner edges of the first and second engagement lips increases, which allows the structural cross member and the flanges of the grid member to be inserted into the clip.

In certain embodiments as otherwise described herein, the first arm of the connection clip includes an aperture therethrough and opening the connection clip includes placing a first tool in the aperture of the first arm and using the first tool to bend the first arm away from the second arm. For example, as shown in FIG. 4, a first tool 272 in the form of a screwdriver is prepared for insertion into first aperture 224 of connection clip 202. In some embodiments, the first tool is inserted through the aperture in order to provide a force on the inner side of the first arm. By providing the force against the inner side of first arm, the tool is able to move the first arm away from the second arm in order to increase the separation between the engagement lips so as to further open the connection clip.

In certain embodiments as otherwise described herein, the second arm of the connection clip includes an aperture therethrough and opening the connection clip includes placing a second tool in the aperture of the second arm and using the second tool to bend the second arm away from the first arm. For example, FIG. 4 also shows a second tool 274, also in the form of a screwdriver, which is prepared for insertion into second aperture 226 on the opposing side of connection clip 202. In some embodiments, similar to the first tool, the second tool is inserted through the second aperture in order to provide a force on the inner side of the second arm of the connection clip. As a result, the second arm can also be urged away from the first arm in order to open the connection clip.

In certain embodiments as otherwise described herein, the first arm of the connection clip includes a tab extending laterally outward from the first arm and opening the connection clip includes placing a first tool behind the tab of the first arm and pressing the first tool against the tab to bend the first arm away from the second arm. For example, in some embodiments, a tool is inserted behind first tab 228 so that it can be used to provide a force against the back of first tab 228. By exerting a force on the inner side or back of first tab 228, the tool can be used to bend the first arm away from the second arm so as to increase the gap between the engagement clips.

In certain embodiments as otherwise described herein, the method further includes using a second connection clip to secure the first panel to the support grid. For example, in FIG. 4, a second connection clip 236 is prepared to secure the opposing end of structural cross member 266 to first grid member 244. In some embodiments, two or more connection clips are installed on the panel in series. In other embodiments, the connection clips are installed simultaneously.

In certain embodiments as otherwise described herein, using the second connection clip includes securing another structural cross member of the first panel to a second grid member of the support grid. For example, in some embodiments, the first panel includes two or more structural cross members that run in parallel across the panel. In certain embodiments, the first panel is attached to the support grid by attaching each of the structural cross members of the panel to the support grid using one or more connection clips.

In certain embodiments as otherwise described herein, the method further includes attaching the connection clip to the structural cross member using a mechanical fastener. For example, in some embodiments a screw is used to secure the connection clip to the structural cross member. In certain embodiments the mechanical fastener passes through a hole in the connection clip, as described above. In other embodiments, the mechanical fastener is driven through the base of the connection clip.

In another aspect, the disclosure provides a method of uninstalling the panel system according to any of the embodiments described above. The method includes opening the connection clip so as to increase a gap between the first and second engagement lips of the connection clip. The connection clip is maneuvered so as to move the first and second flanges of the first grid member through the gap between the first and second engagement lips, and also maneuvered so as to move the structural cross member of the first panel through the gap between the first and second engagement lips and remove the structural cross member from the cavity of the connection clip. The first panel is then separated from the first grid member.

Figure 5:
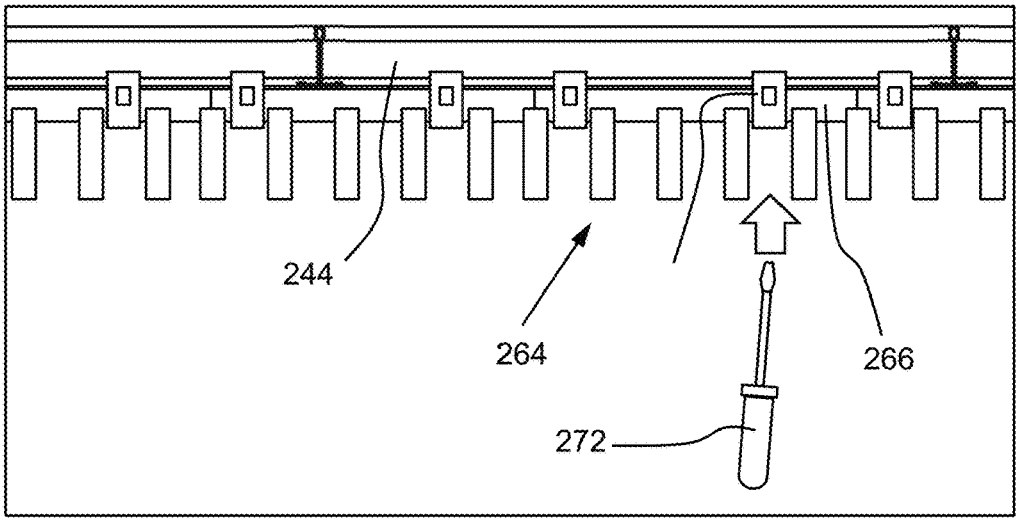
FIG. 5 is a schematic side view of the panel system of FIG. 3 in a first position during an uninstallation according to an embodiment of the disclosure.
Figure 6:
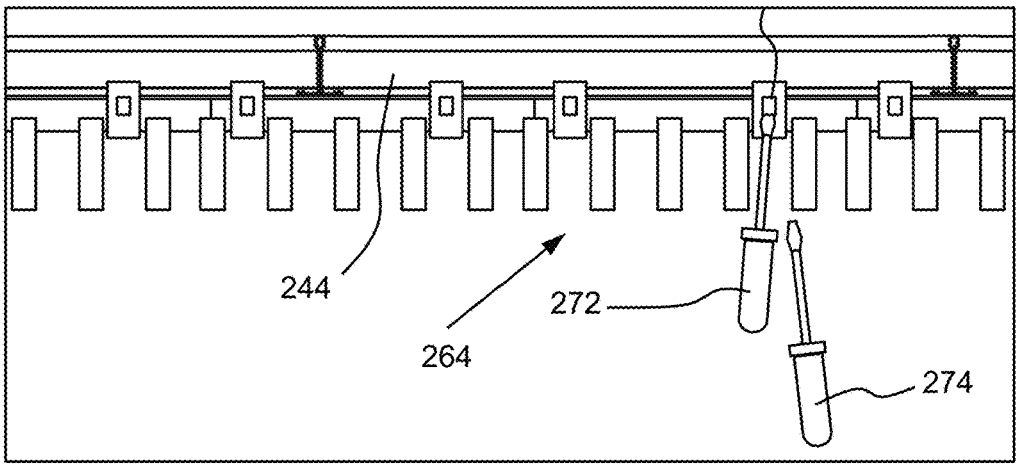
FIG. 6 is a schematic side view of a second position during the uninstallation of FIG. 5.
Figure 7:
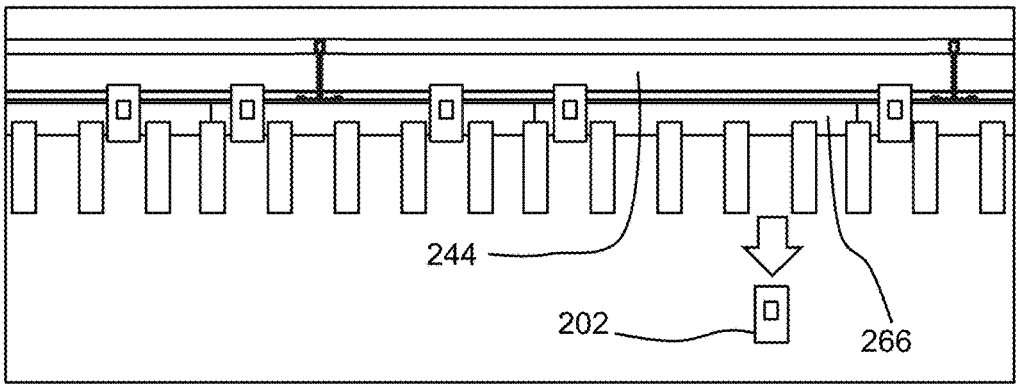
FIG. 7 is a schematic side view of a third position during the uninstallation of FIG. 5.

Such a method is illustrated with respect to FIGS. 5 to 7. The panel system begins in the installed position, as shown in FIG. 5, with connection clip 202 holding first panel 264 and first grid member 244 together. The connection clip 202 is then opened in FIG. 6 and moved downward so as to move the first grid member 244 and the structural cross member 266 of first panel 264 through the gap between the first and second engagement lips of the clip.

In certain embodiments as otherwise described herein, opening the connection clip includes spreading the first and second arms so as to increase the gap between the first and second engagement lips of the connection clip. For example, in some embodiments in order to remove the connection clip from the first grid member and the structural cross member, the first and second arms of the connection clip are pulled away from one another by temporarily flexing the clip. This flexing of the clip can cause an increase in the angles between the arms and the base as well as an arcing of the arms and/or base. The result flexing the clip is that the gap of space between the inner edges of the first and second engagement lips increases, which allows the structural cross member and the flanges of the grid member to be removed from the clip.

In certain embodiments as otherwise described herein, the first arm of the connection clip includes an aperture therethrough, and opening the connection clip includes placing a first tool in the aperture of the first arm and using the first tool to bend the first arm away from the second arm. Similar to the description above with respect to methods of installing the connection clip, in some embodiments inserting the first tool into the aperture allows the tool to press against the inner surface of the corresponding arm in order to flex the arms of the clip in opposite directions and open the clip.

In certain embodiments as otherwise described herein, the second arm of the connection clip includes an aperture therethrough and opening the connection clip includes placing a second tool in the second arm and using the second tool to bend the second arm away from the first arm. In certain embodiments, while providing an opening force on the first arm using the first tool, a second tool is used to provide an opposing force on the second arm. These two opposing forces allows for flexing both arms in a manner that spreads the gap between the engagement lips and thereby opens the connection clip.

In certain embodiments as otherwise described herein, the first arm of the connection clip includes a tab extending laterally outward from the first arm and opening the connection clip includes placing a first tool behind the tab of the first arm and pressing the first tool against the tab to bend the first arm away from the second arm. For example, in FIG. 6 first tool 272 is inserted behind first tab 228 so that a force can be provided on the inside surface of first tab 228. The force applied to the inner side of first tab 228 results in an outward bending of first arm 210, which opens the connection clip and allows removal of the first grid member 244 and structural cross member 266.

In certain embodiments as otherwise described herein, the connection clip is initially attached to the structural cross member using a mechanical fastener, the method further comprising removing the mechanical fastener before opening the connection clip. For example, in some embodiments, mechanical fasteners such as screws are removed from the connection clips before the connection clips are removed from the first grid member.

Additional aspects of the disclosure are provided by the following enumerated embodiments, which can be combined in any number and in any fashion that is not logically or technically inconsistent.

Embodiment 1. A connection clip for securing a panel to a support grid, the connection clip comprising:

a body including:

a base having a width extending between opposing first and second lateral edges; and first and second arms extending upward respectively from the first and second lateral edges of the base so as to form a cavity configured to receive a structural cross member of the panel;

a first engagement lip extending laterally inward from an upper end of the first arm and configured to grip a first flange of a grid member of the support grid, the first engagement lip spanning a substantial majority of the depth of the connection clip; and a second engagement lip extending laterally inward from an upper end of the second arm and configured to grip a second flange of the grid member so as to secure the panel to the grid member, the second engagement lip spanning a substantial majority of the depth of the connection clip.

Embodiment 2. The connection clip according to embodiment 1, wherein the depth of each of the base, arms and engagement lips are substantially equal.

Embodiment 3. The connection clip according to embodiment 1 or embodiment 2, wherein each of the base, arms and engagement lips is composed of a planar element.

Embodiment 4. The connection clip according to any of embodiments 1 to 3, wherein the connection clip is formed from a bent metal sheet.

Embodiment 5. The connection clip according to any of embodiments 1 to 4, wherein each of the first and second arms form an acute angle with the base.

Embodiment 6. The connection clip according to any of embodiments 1 to 5, wherein the first arm includes an aperture therethrough.

Embodiment 7. The connection clip according to embodiment 6, wherein the aperture is positioned on an upper portion of the first arm.

Embodiment 8. The connection clip according to embodiment 6 or embodiment 7, wherein the second arm also includes an aperture therethrough.

Embodiment 9. The connection clip according to any of embodiments 1 to 8, further comprising a tab extending laterally outward from the first arm.

Embodiment 10. The connection clip according to embodiment 9, wherein the first arm includes an aperture therethrough and the tab is aligned with the aperture of the first arm.

Embodiment 11. The connection clip according to embodiment 10, wherein the tab is a flap that is punched from the aperture of the first arm.

Embodiment 12. The connection clip according to any of embodiments 1 to 11, wherein the base includes a hole configured to receive a mechanical fastener.

Embodiment 13. The connection clip according to any of embodiments 1 to 12, wherein the connection clip has a depth between 0.25 and 2 inches, e.g., between 0.5 and 1 inch, e.g., about 0.75 inches.

Embodiment 14. The connection clip according to any of embodiments 1 to 13, wherein the connection clip has a width between 0.75 and 2 inches, e.g., between 1 and 1.5 inches.

Embodiment 15. A panel system comprising:

a support grid including a plurality of grid members including a first grid member;

a plurality of panels each including a structural cross member extending across the respective panel, the plurality of panels including a first panel; and a connection clip according to any of embodiments 1 to 14 securing the first panel to the first grid member, wherein the structural cross member of the first panel is received in the cavity formed by the body of the connection clip, and wherein the first and second engagement lips of the connection clip grip respective first and second flanges of the first grid member so as to secure the first panel to the first grid member.

Embodiment 16. The panel system according to embodiment 15, wherein the first panel is a ceiling panel and the support grid is a ceiling grid.

Embodiment 17. The panel system according to embodiment 15 or embodiment 16, wherein the first grid member is a t-beam including a central web extending upward from the first and second flanges.

Embodiment 18. The panel system according to any of embodiments 15 to 17, wherein the structural cross member of the first panel abuts the first grid member.

Embodiment 19. The panel system according to any of embodiments 15 to 18, further comprising a second connection clip securing the first panel to the support grid.

Embodiment 20. The panel system according to embodiment 19, wherein the second connection clip also secures the structural cross member of the first panel to the first grid member.

Embodiment 21. The panel system according to embodiment 19, wherein the second connection clip secures another structural cross member of the first panel to a second grid member of the support grid.

Embodiment 22. The panel system according to any of embodiments 15 to 21, wherein each of the plurality of panels is secured to the support grid with connection clips.

Embodiment 23. The panel system according to any of embodiments 15 to 22, wherein the first panel includes a wood grille including a plurality of blades, and wherein each of the blades is attached to the structural cross member.

Embodiment The panel system according to embodiment 23, wherein the structural cross member is disposed at the top of the first panel.

Embodiment 25. The panel system according to embodiment 24, wherein the structural cross member has a dovetail shape, and wherein at least a portion of the structural cross member extends through the blades, Embodiment 26. The panel system according to embodiment 25, wherein an upper portion of the structural cross member projects out from a top surface the blades.

Embodiment 27. The panel system according to any of embodiments 15 to 26, wherein the connection clip is attached to the structural cross member using a mechanical fastener.

Embodiment 28. The panel system according to embodiment 27, wherein the mechanical fastener passes through a hole in the base of the connection clip.

Embodiment 29. A method of installing the panel system of any of embodiments 15 to 28, the method comprising:

aligning the structural cross member of the first panel with the first grid member;

opening the connection clip so as to provide access to the cavity formed by the body of the connection clip;

inserting the structural cross member of the first panel into the cavity;

inserting the first and second flanges of the first grid member into the cavity; and positioning the first and second engagement lips of the connection clip to respectively grip the first and second flanges of the first grid member so as to secure the first panel to the first grid member.

Embodiment 30. The method according to embodiment 29, further comprising placing the structural cross member against the first grid member.

Embodiment 31. The method according to embodiment 29 or embodiment 30, wherein opening the connection clip includes spreading the first and second arms so as to increase a gap between the first and second engagement lips of the connection clip.

Embodiment 32. The method according to embodiment 31, wherein the first arm of the connection clip includes an aperture therethrough, and wherein opening the connection clip includes placing a first tool in the aperture of the first arm and using the first tool to bend the first arm away from the second arm.

Embodiment 33. The method according to embodiment 32, wherein the second arm of the connection clip includes an aperture therethrough, and wherein opening the connection clip includes placing a second tool in the aperture of the second arm and using the second tool to bend the second arm away from the first arm.

Embodiment 34. The method according to any of embodiments 31 to 33, wherein the first arm of the connection clip includes a tab extending laterally outward from the first arm, and wherein opening the connection clip includes placing a first tool behind the tab of the first arm and pressing the first tool against the tab to bend the first arm away from the second arm.

Embodiment 35. The method according to any of embodiments 29 to 34, further comprising using a second connection clip to secure the first panel to the support grid.

Embodiment 36. The method according to embodiment 35, wherein using the second connection clip includes securing another structural cross member of the first panel to a second grid member of the support grid.

Embodiment 37. The method according to any of embodiments 29 to 36, further comprising attaching the connection clip to the structural cross member using a mechanical fastener.

Embodiment 38. A method of uninstalling the panel system of any of embodiments 15 to 27, the method comprising:

opening the connection clip so as to increase a gap between the first and second engagement lips of the connection clip;

maneuvering the connection clip so as to move the first and second flanges of the first grid member through the gap between the first and second engagement lips;

maneuvering the connection clip so as to move the structural cross member of the first panel through the gap between the first and second engagement lips and remove the structural cross member from the cavity of the connection clip; and separating the first panel from the first grid member.

Embodiment 39. The method according to embodiment 38, wherein opening the connection clip includes spreading the first and second arms so as to increase the gap between the first and second engagement lips of the connection clip.

Embodiment 40. The method according to embodiment 39, wherein the first arm of the connection clip includes an aperture therethrough, and wherein opening the connection clip includes placing a first tool in the aperture of the first arm and using the first tool to bend the first arm away from the second arm, Embodiment 41. The method according to embodiment 40, wherein the second arm of the connection clip includes an aperture therethrough, and wherein opening the connection clip includes placing a second tool in the second arm and using the second tool to bend the second arm away from the first arm.

Embodiment 42. The method according to any of embodiments 39 to 41, wherein the first arm of the connection clip includes a tab extending laterally outward from the first arm, and wherein opening the connection clip includes placing a first tool behind the tab of the first arm and pressing the first tool against the tab to bend the first arm away from the second arm.

Embodiment 43. The method according to any of embodiments 38 to 42, wherein the connection clip is initially attached to the structural cross member using a mechanical fastener, the method further comprising removing the mechanical fastener before opening the connection clip.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

What is claimed is:

1. A connection clip for securing a panel to a support grid, the connection clip comprising:

a body including:

a base having a width extending between opposing first and second lateral edges; and first and second arms extending upward respectively from the first and second lateral edges of the base so as to form a cavity configured to receive a structural cross member of the panel, wherein each of the first and second arms form an acute angle with the base, and wherein the first and second arms are angled toward one another forming a constricted opening to the cavity;

a first engagement lip extending laterally inward from an upper end of the first arm and configured to grip a first flange of a grid member of the support grid, the first engagement lip spanning a substantial majority of a depth of the connection clip; and a second engagement lip extending laterally inward from an upper end of the second arm and configured to grip a second flange of the grid member so as to secure the panel to the grid member, the second engagement lip spanning a substantial majority of the depth of the connection clip.

2. The connection clip according to claim 1, wherein a depth of each of the base, arms and engagement lips are substantially equal.

3. The connection clip according to claim 1, wherein each of the base, arms and engagement lips is composed of a planar element.

4. The connection clip according to claim 1, wherein the first arm includes an aperture therethrough.

5. The connection clip according to claim 4, wherein the aperture is positioned on an upper portion of the first arm.

6. The connection clip according to claim 4, wherein the second arm also includes an aperture therethrough.

7. The connection clip according to claim 1, further comprising a tab extending laterally outward from the first arm.

8. The connection clip according to claim 1, wherein the connection clip has a depth between 0.25 and 2 inches, e.g., between 0.5 and 1 inch, e.g., about 0.75 inches, and a width between 0.75 and 2 inches, e.g., between 1 and 1.5 inches.

9. A panel system comprising:

a support grid including a plurality of grid members including a first grid member;

a plurality of panels each including a structural cross member extending across the respective panel, the plurality of panels including a first panel; and a connection clip according to claim 1 securing the first panel to the first grid member, wherein the structural cross member of the first panel is received in the cavity formed by the body of the connection clip, and wherein the first and second engagement lips of the connection clip grip respective first and second flanges of the first grid member so as to secure the first panel to the first grid member.

10. The panel system according to claim 9, wherein the first panel is a ceiling panel and the support grid is a ceiling grid.

11. The panel system according to claim 10, wherein the first grid member is a t beam including a central web extending upward from the first and second flanges.

12. The panel system according to claim 10 further comprising a second connection clip securing the first panel to the support grid.

13. The panel system according to claim 12, wherein the second connection clip also secures the structural cross member of the first panel to the first grid member.

14. The panel system according to claim 12, wherein the second connection clip secures another structural cross member of the first panel to a second grid member of the support grid.

15. The panel system according to claim 10, wherein the first panel includes a wood grille including a plurality of blades, and wherein each of the blades is attached to the structural cross member.

16. The panel system according to claim 15, wherein the structural cross member is disposed at the top of the first panel and has a dovetail shape, and wherein at least a portion of the structural cross member extends through the blades, with an upper portion of the structural cross member projecting out from a top surface of the blades.

17. A method of installing the panel system of claim 10, the method comprising:

aligning the structural cross member of the first panel with the first grid member;

opening the connection clip so as to provide access to the cavity formed by the body of the connection clip;

inserting the structural cross member of the first panel into the cavity;

inserting the first and second flanges of the first grid member into the cavity; and positioning the first and second engagement lips of the connection clip to respectively grip the first and second flanges of the first grid member so as to secure the first panel to the first grid member.

18. The method according to claim 17, wherein opening the connection clip includes spreading the first and second arms so as to increase a gap between the first and second engagement lips of the connection clip.

19. The method according to claim 18, wherein the first arm of the connection clip includes an aperture therethrough, and wherein opening the connection clip includes placing a first tool in the aperture of the first arm and using the first tool to bend the first arm away from the second arm.

* * * * *